US006161461A

United States Patent [19]

Hupfeld et al.

[11] Patent Number: 6,161,461

[45] Date of Patent: Dec. 19, 2000

[54] TRAINING DEVICE FOR A COMBAT VEHICLE WITH A HEAVY WEAPON, ESPECIALLY AN ARMORED HOWITZER

[75] Inventors: Heinrich Hupfeld, Spangenberg; Peter Liebel, Kassel, both of Germany

[73] Assignee: Krauss-Maffei Wegmann GmbH & Co. KG, Kassel, Germany

[21] Appl. No.: 09/252,342

[22] Filed: Feb. 18, 1999

[30] Foreign Application Priority Data

Feb. 25, 1998 [DE] Germany ..... 198 07 976

[51] Int. Cl.[7] ..... F41A 21/00

[52] U.S. Cl. ..... 89/29; 89/45; 42/77

[58] Field of Search ..... 89/29, 45, 47; 42/77

[56] References Cited

U.S. PATENT DOCUMENTS

| | | | |
|---|---|---|---|
| 2,857,812 | 10/1958 | Nichols | 89/29 |
| 5,463,930 | 11/1995 | Bisping et al. | 89/29 |
| 5,773,747 | 6/1998 | Tellander et al. | 89/47 |
| 5,831,201 | 11/1998 | Andersson et al. | 89/47 |
| 5,886,280 | 3/1999 | Collins | 89/29 |

*Primary Examiner*—J. Woodrow Eldred
*Attorney, Agent, or Firm*—Chadbourne & Parke LLP

[57] ABSTRACT

A training device for a combat vehicle with a heavy weapon, especially an armored howitzer. A shorter practice barrel replaces the weapon's regular barrel, but has the same sort of attachments at its inner end as the regular barrel has for fastening it to accommodations in the vehicle. A magazine at the outer end of the practice barrel accommodates rammed practice shells, which are decelerated and forwarded to magazine shafts offside the axis of the barrel. Practice shells of essentially the same weight and dimensions as regular shells and an impact absorber at the front for accepting the impact of a brake, are accommodated in the magazine. An accessory device for removing the practice shells from the magazine comprises a framework that travels on rollers and is provided with a platform for operating personnel and with a hydraulic lift that accepts used practice shells from the magazine and lowers them to the ground.

21 Claims, 12 Drawing Sheets

TRAINING DEVICE FOR A COMBAT VEHICLE WITH A HEAVY WEAPON, ESPECIALLY AN ARMORED HOWITZER

BACKGROUND OF THE INVENTION

The present invention concerns a training device for a combat vehicle with a heavy weapon, especially an armored howitzer.

The object is a very simple training device of this type that can be employed in simulation exercises to practice all the activities involved in operating the main weapon, the flow of automatically rammed ammunition, and all substitute operations. The possibility for simulated cadence firing of a prescribed number of practice rounds subject to serial-like conditions but without recoil is also intended.

SUMMARY OF THE INVENTION

This object is attained in accordance with the present invention by a) a shorter practice barrel that replaces the weapon's regular barrel but has the same sort of attachments at its inner end as the regular barrel has for fastening it to accommodations in the vehicle, b) a magazine at the outer end of the practice barrel that accommodates rammed practice shells, which are decelerated and forwarded to magazine shafts offside the axis of the barrel, c) practice shells of essentially the same weight and dimensions as regular shells and having means at the front for accepting the impact of a brake accommodated in the magazine, and d) an accessory device for removing the practice shells from the magazine and comprising a framework that travels on rollers and is provided with a platform for operating personnel and with a hydraulic lift that accepts used practice shells from the magazine and lowers them to the ground.

Advantageous advanced embodiments of the training device in accordance with the present invention will be specified hereinafter by way of examples.

The training device in accordance with the present invention essentially comprises four collaborating components, specifically the practice barrel that replaces the weapon's regular barrel, the magazine at the outer end of the barrel for accommodating the rammed shells; specially designed practice shells of the same weight and dimensions as regular shells, and an accessory device for removing the rammed practice shells from the magazine.

Any armored howitzer can be turned into a training vehicle by replacing its regular barrel with a practice barrel supported by the other components of the training device in accordance with the present invention. The training device is simple, easy to operate, and can be fitted with any necessary safety equipment. One embodiment of a training device in accordance with the present invention will now be specified by way of example with reference to the accompanying drawing, wherein:

DETAILED DESCRIPTION OF THE INVENTION

Figure 1:
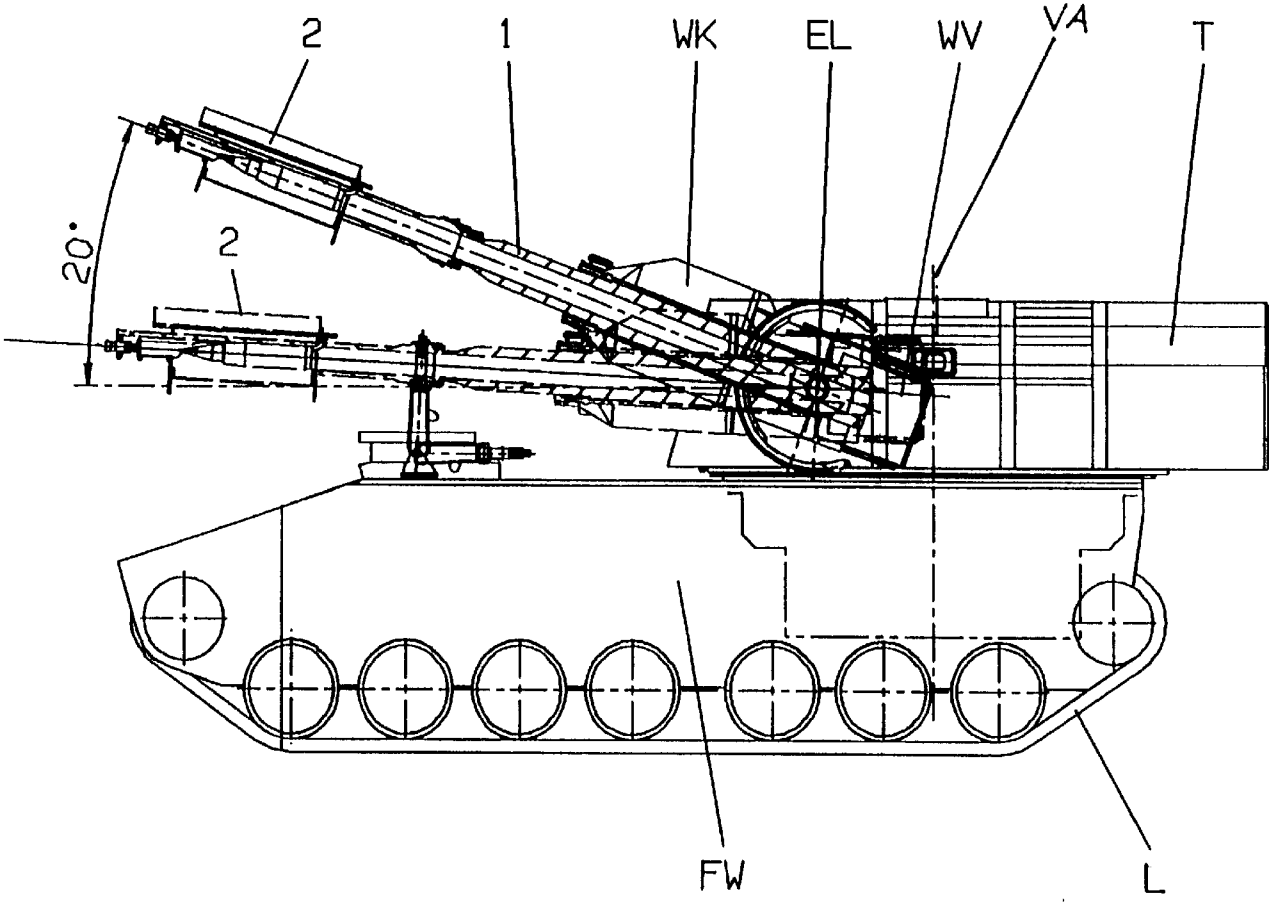
FIG. 1 is a highly schematic side view of an armored howitzer equipped with a training device in accordance with the present invention and with the barrel at two different elevations.

FIG. 1 illustrates an armored howitzer with a hull FW, catenary traveling gear L, and a turret T that rotates around a vertical axis VA. A cradle WK pivots up and down around an axis EL of elevation in the front of turret T with a conventional breech WV mounted on its inner end. Accommodated in cradle WK instead of a regular barrel is a practice barrel 1. To facilitate replacing the regular barrel as much as possible, practice barrel 1 is mounted in the vehicle with the same type of attachments as a regular barrel. Barrel 1 has a smooth bore, is mounted in cradle WK, and is secured to an industrially produced breech WV.

FIG. 1 represents barrel 1 at two different elevations, one of 20° in continuous lines and one of 0° with discontinuous lines.

Figure 2:
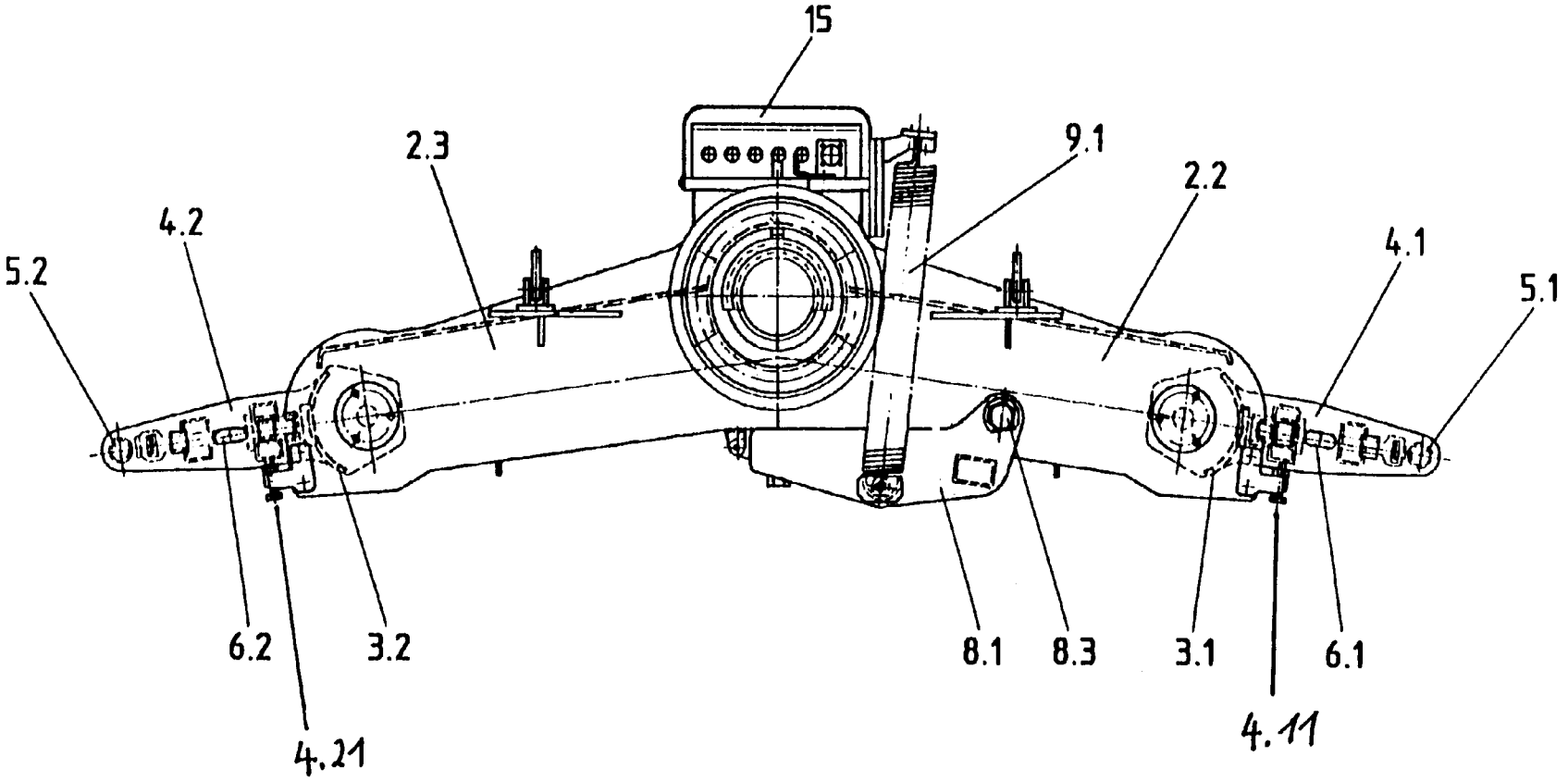
FIG. 2 is a front view of the magazine employed in the training device illustrated in FIG. 1.
Figure 3:
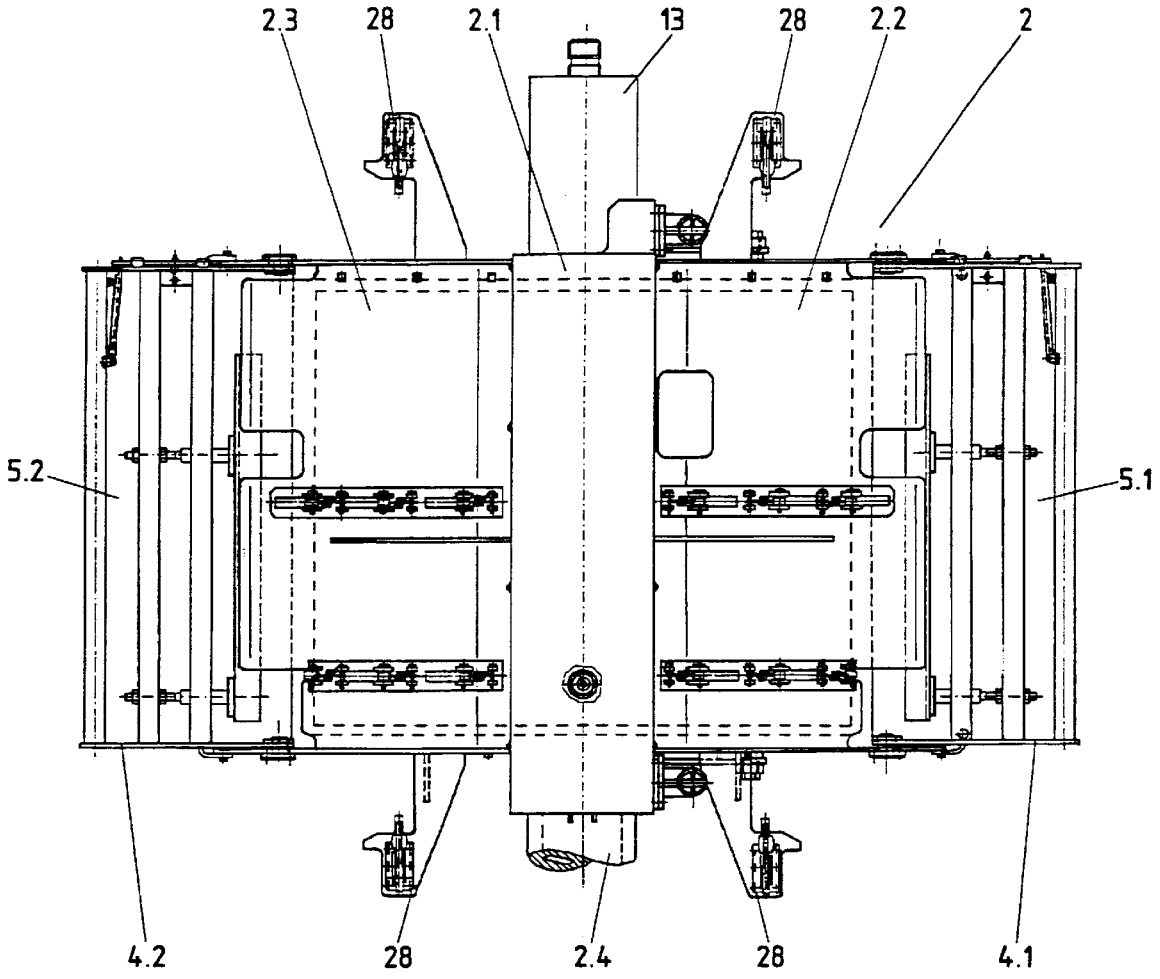
FIG. 3 is a top view of the magazine illustrated in FIG. 2.
Figure 4:
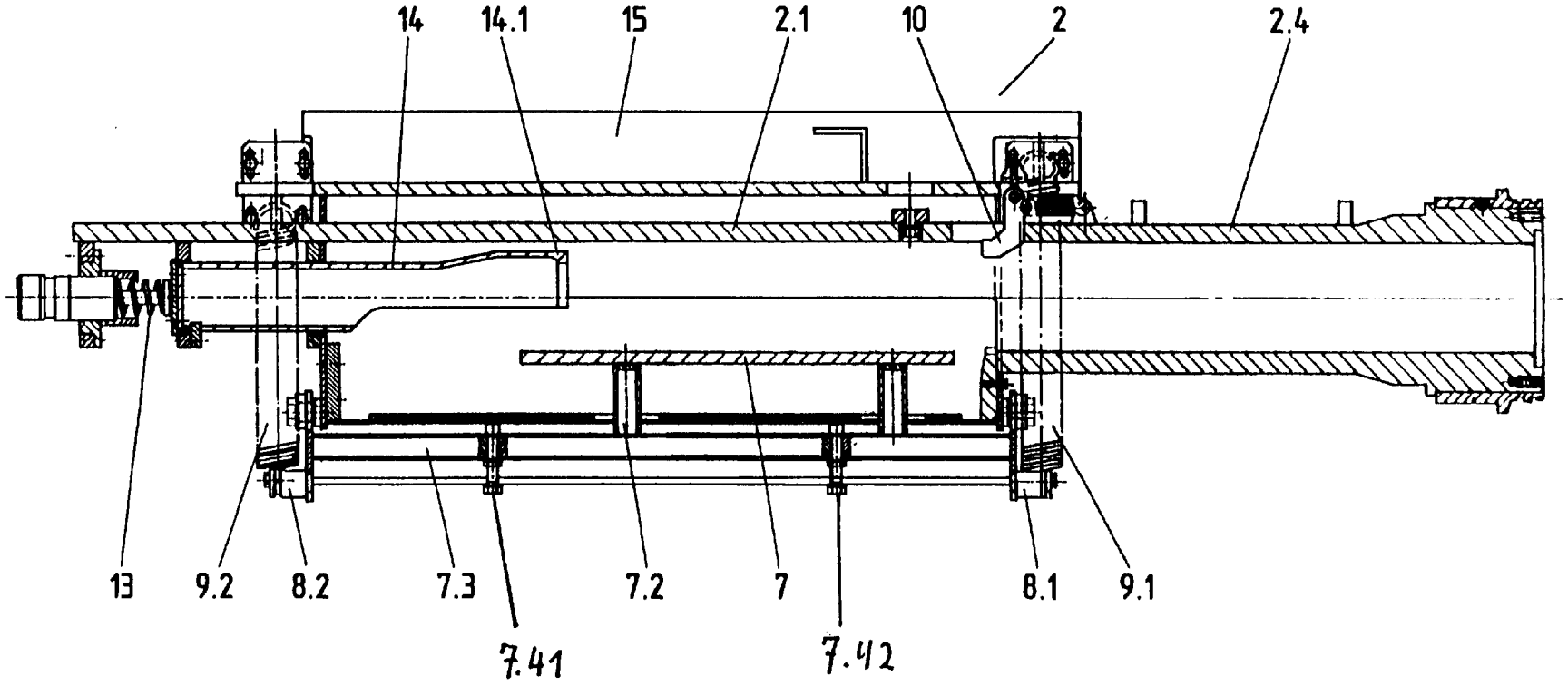
FIG. 4 is a longitudinal section through the magazine illustrated in FIGS. 2 and 3.

At the outer end of barrel 1 is a magazine 2 that accommodates rammed practice shells and that will be specified hereinafter with reference to FIGS. 2 through 4.

Magazine 2 is provided with an accommodation 2.1 that extends coaxial with the barrel's bore and communicates with a tubular connector 2.4. At the front of accommodation 2.1 is a brake for decelerating the practice shells as they enter the accommodation. The accommodation is provided with a shock absorber 13. Resting against the inner section of shock absorber 13 is a tray 14 that travels back and forth inside accommodation 2.1. Tray 14 is at least partly in the form of a bowl and has a stop 14.1 on its inner edge that comes to rest as will be specified in greater detail hereinafter against an impact-accommodating shoulder 16.14 (FIGS. 11 and 12) on a practice shell 16.1. Accommodation 2.1 also includes a rail 7 that supports and centers an oncoming practice shell 16.1 that slides along it.

Mounted on each side of accommodation 2.1 is a magazine shaft 2.2 and 2.3, each designed in the present example to contain two practice shells. To ensure satisfactory roll-off of the practice shells decelerated in accommodation 2.1 as will be specified hereinafter, magazine shafts 2.2 and 2.3 are mounted on accommodation 2.1 at a slight angle to the plane defined by the axis of barrel 1 and the axis EL of elevation.

Magazine shafts 2.2 and 2.3 have shell-removal openings at each end. Each opening can be closed off by a pivoting cap 3.1 and 3.2. Each cap is connected to outward-extending pivoting arms 4.1 and 4.2 that are in turn connected together by grappling rods 5.1 and 5.2. When caps 3.1 and 3.2 are closed, arms 4.1 and 4.2 can be locked into position by mechanisms 6.1 and 6.2. The arms' particular position can be established with screws 4.11 and 4.21.

Rail 7 rests on a beam 7.3 by way of supports 7.2 that extend through the floor of accommodation 2.1. Beam 7.3 is attached to the free ends of suspension levers 8.1 and 8.2 suspended, one on the front and the other on the back of magazine 2 in the vicinity of first magazine shaft 2.2 at a point 8.3 of articulation. Levers 8.1 and 8.2 are subject to a downward force applied by tension springs 9.1 and 9.2. Rail 7 can be raised and lowered and tilted by means of screws 7.41 and 7.42.

The upper surface 7.1 of rail 7 is contoured to ensure that, as will be specified in greater detail hereinafter, any practice shell decelerated inside accommodation 2.1 will roll off into first magazine shaft 2.2 subsequent to the descent of rail 7.

Figure 5A:
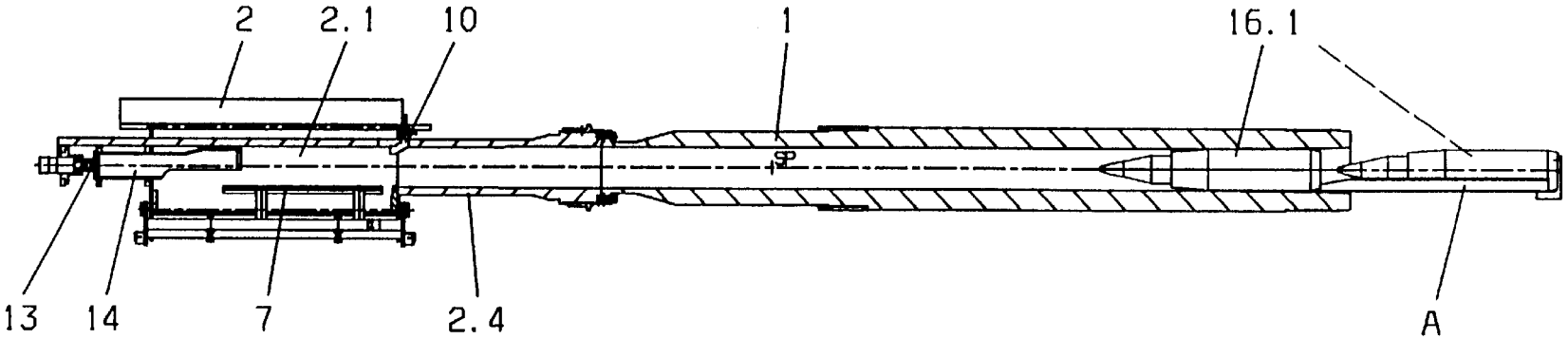
FIG. 5A is a longitudinal section through the practice barrel and the magazine from the training device illustrated in FIGS. 1 through 4 during the initial stage of ramming.
Figure 5B:
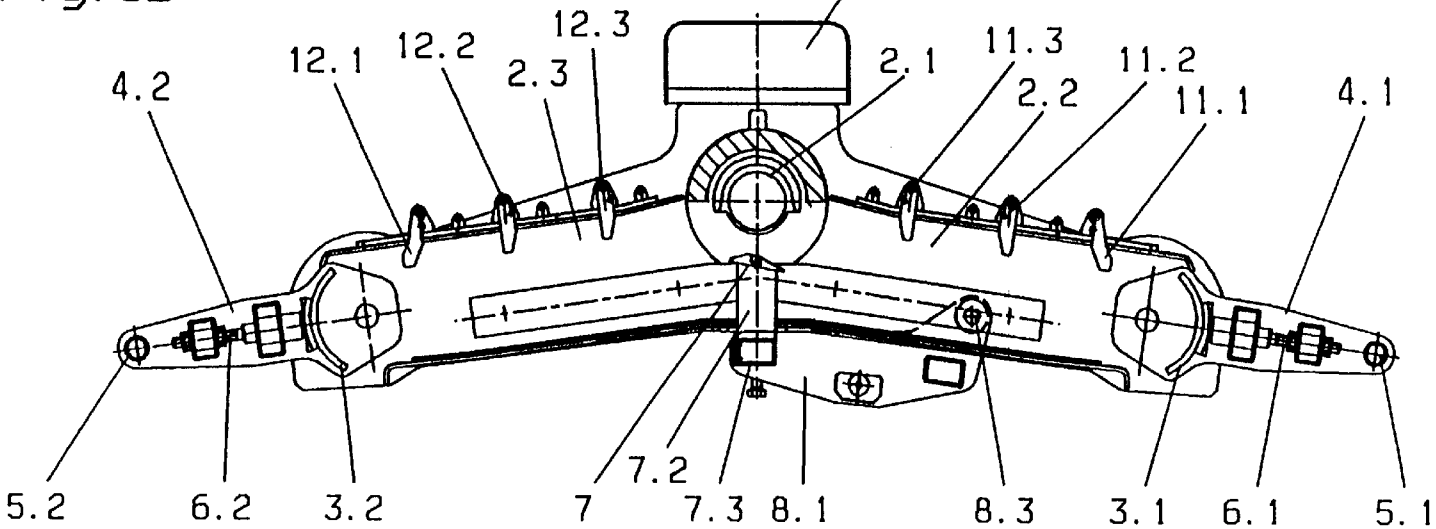
FIG. 5B is a transverse section through the magazine illustrated in FIG. 5A during the same stage.
Figure 6A:
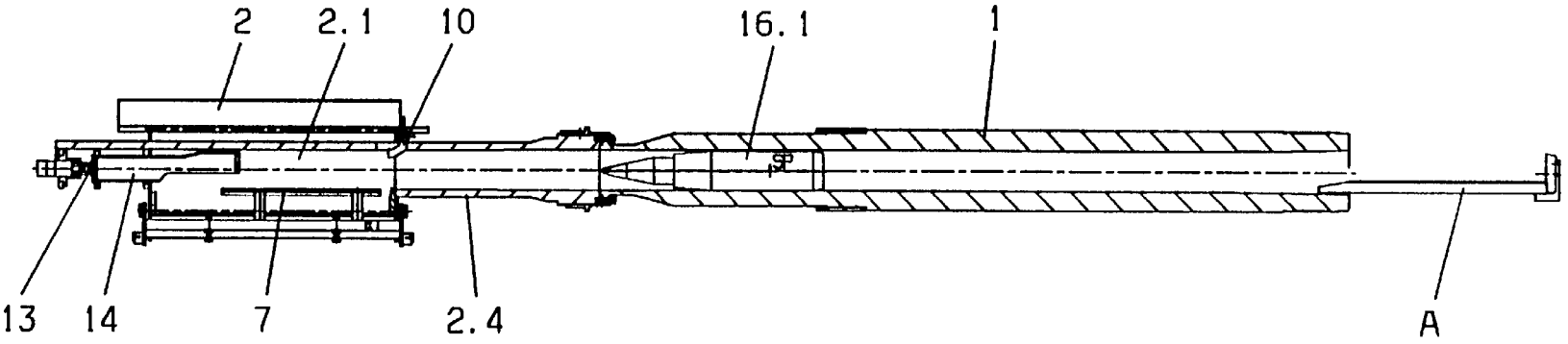
FIG. 6A is a section similar to that in FIG. 5A through the practice barrel and magazine during the second stage of ramming.
Figure 6B:
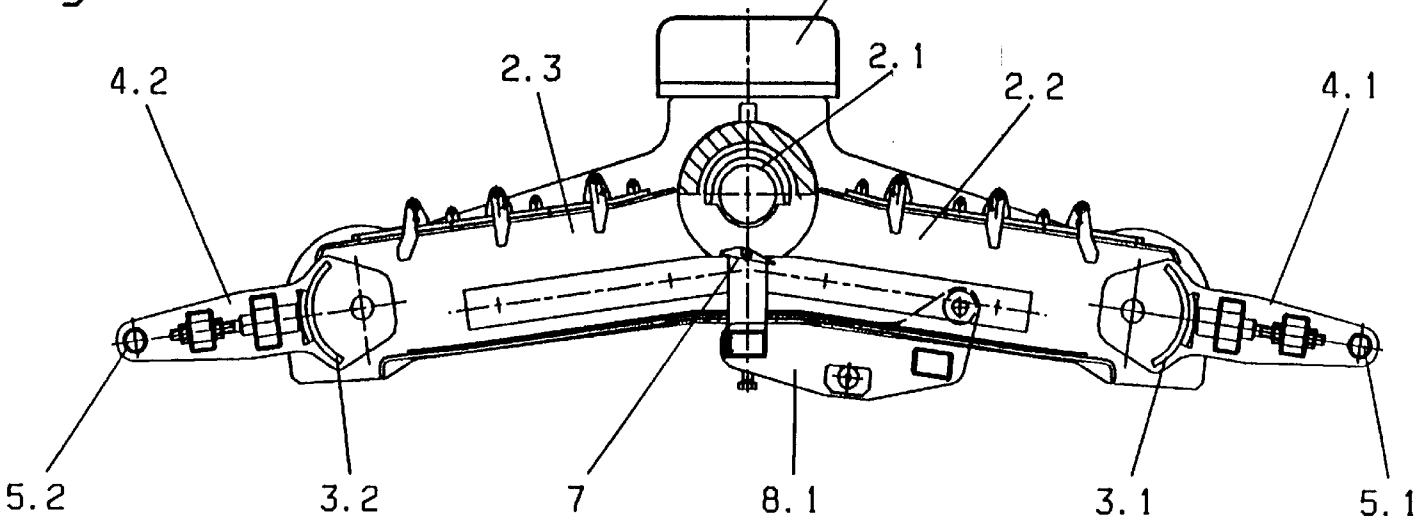
FIG. 6B is a transverse section through the magazine illustrated in FIG. 6A during the same stage.

Referring to FIGS. 5A and 5B, first magazine shaft 2.2 accommodates releasable latches 11.1 through 11.3 and second magazine shaft 2.3 accommodates releasable latches 12.1 through 12.3 that determine the position of the practice shells in the shafts.

The entry end of magazine accommodation 2.1 is provided with a latch 10 that prevents a decelerated shell from dropping back to the rear.

Unillustrated sensors and light barriers monitor the states of levers 8.1 and 8.2, arms 4.1 and 4.2, and shell drop-back prevention latch 10 and the position of any shells in accommodation 2.1 or magazine shafts 2.2 and 2.3. The electronic controls and connections are enclosed in a hood 15 on top of accommodation 2.1.

Figure 11:
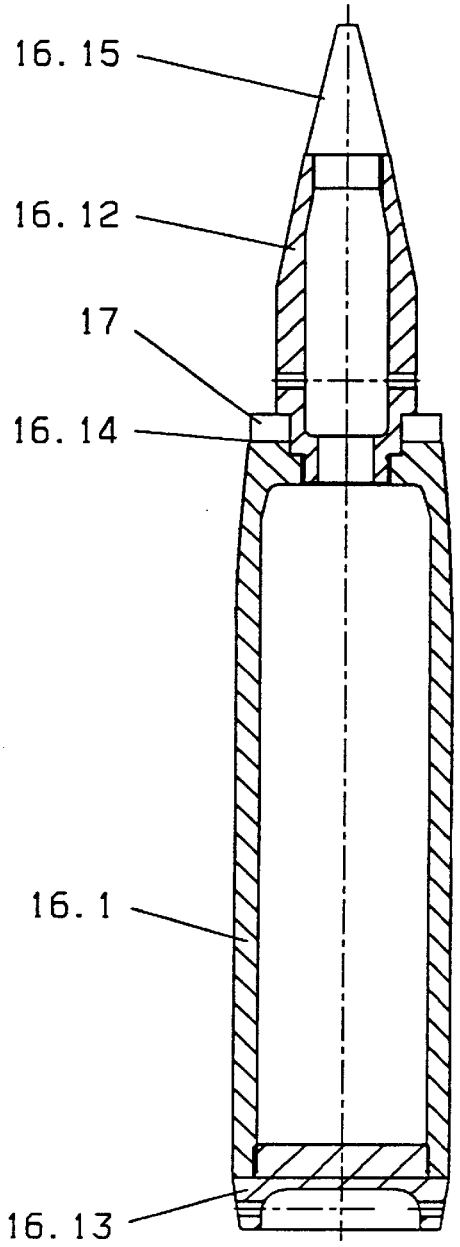
FIG. 11 is a section through the training device illustrated in FIGS. 1 through 10.
Figure 12:
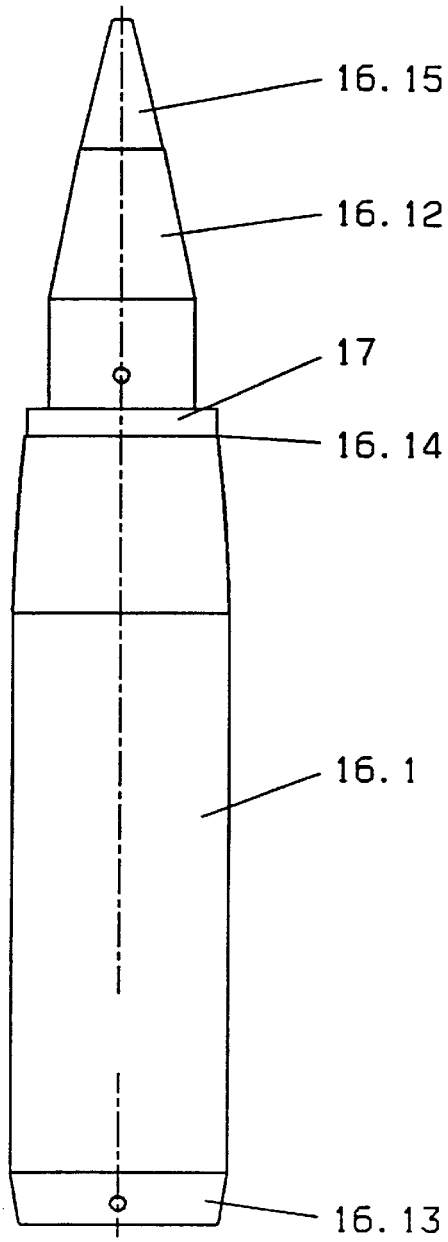
FIG. 12 is a side view of the practice shell illustrated in FIG. 11.

FIGS. 11 and 12 illustrate a practice shell 16.1 of the type to be employed in a training device in accordance with the present invention. The shell is specially designed for use with such a device and simulates with few exceptions an ordinary explosive shell, a bomblette for instance. The shell has a hull 16.1, an ogive 16.12 toward the tip, and a removable base 16.13 at the rear. Turned out of the section adjacent to ogive 16.12 is an impact-accommodating shoulder 16.14. Ogive 16.12 is screwed on in the vicinity of shoulder 16.14. A replaceable plastic shock absorption ring has been mounted around impact-accommodating shoulder 16.14. The shot can also be provided with a screw-in fuse 16.15.

How the practice rounds are set off and how the practice shells accumulate in the magazine 2 will now be specified with reference to FIGS. 5A through 10B.

Figure 7A:
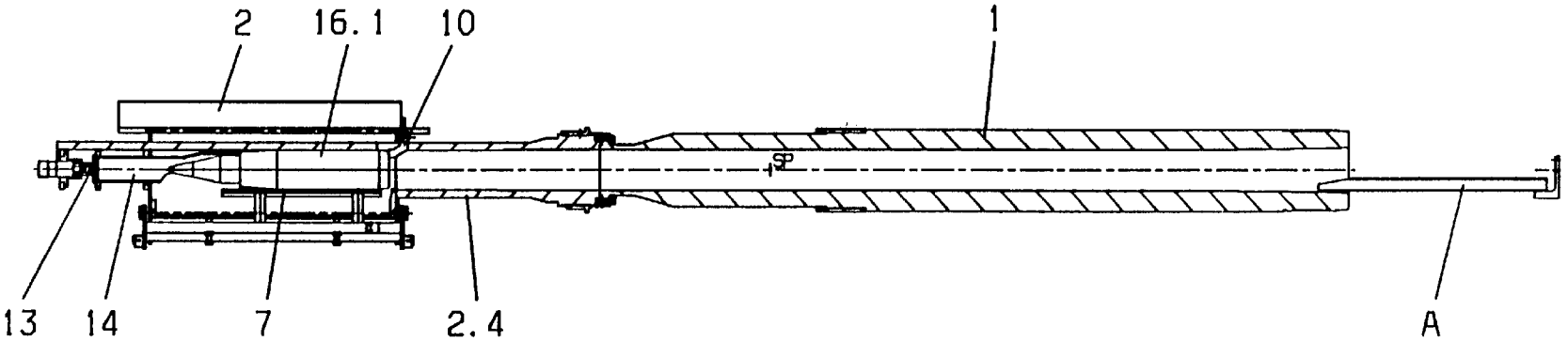
FIG. 7A is a section similar to that in FIG. 5A through the practice barrel and magazine during the third stage of ramming.
Figure 7B:
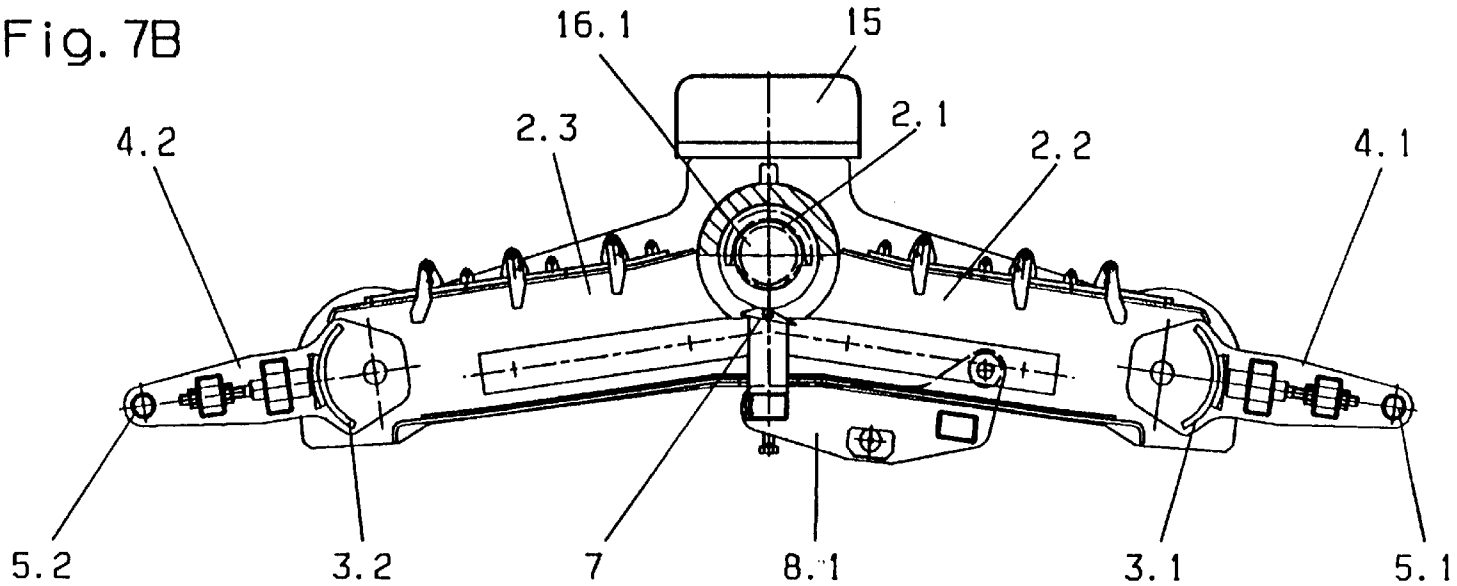
FIG. 7B is a transverse section through the magazine illustrated in FIG. 7A during the same stage.

The shells are forwarded from the vehicle's shell-supply magazine to an unillustrated breach with a conventional rammer A by a conventional ammunition feed as illustrated in FIGS. 5A and 5B. In an initial stage, a shell 16.1 is thrust into barrel 1 by rammer A and travels forward to magazine 2. In a second stage, illustrated in FIGS. 6A and 6B, the shell is catapulted into magazine 2 through the smooth bore of barrel 1. Shell 16.1 is then decelerated inside magazine 2 as illustrated in FIGS. 7A and 7B as it enters tray 14 and its impact-accommodating shoulder 16.14 encounters stop 14.1. Shock absorber 13 absorbs the residual ramming energy. Shell 16.1 is now taken over by rail 7, latch 10 preventing it from dropping back into the bore. Latch 10 is electronically monitored. The position of the shell is detected by a light barrier halfway along.

Figure 8A:
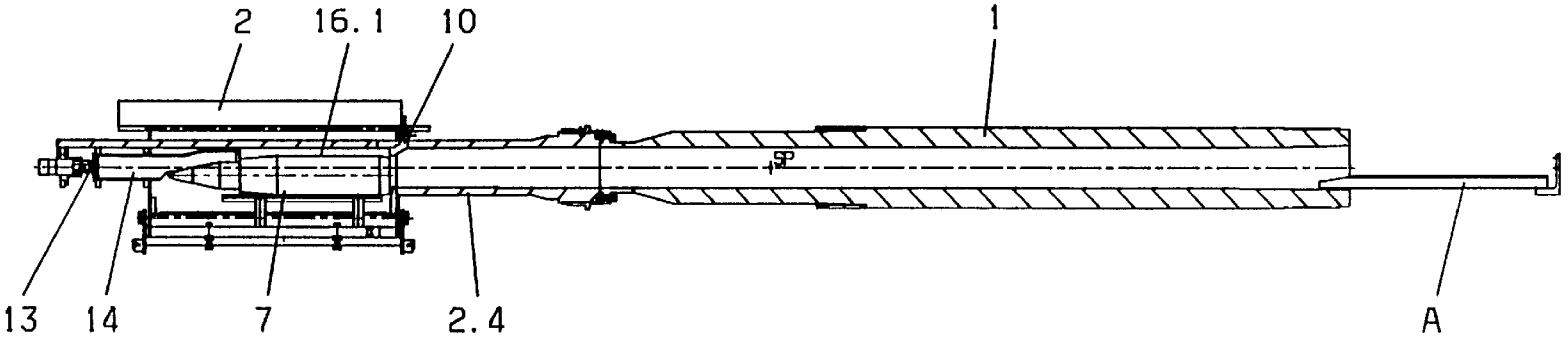
FIG. 8A is a section similar to that in FIG. 5A through the practice barrel and magazine during the fourth stage of ramming.
Figure 8B:
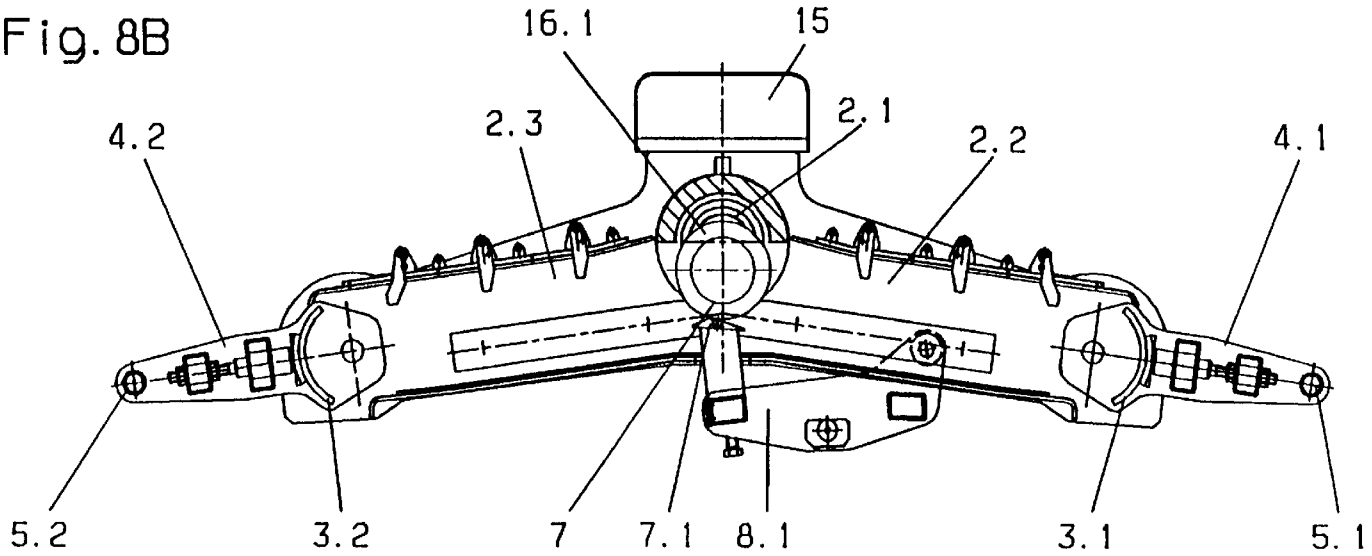
FIG. 8B is a transverse section through the magazine illustrated in FIG. 8A during the same stage.
Figure 9A:
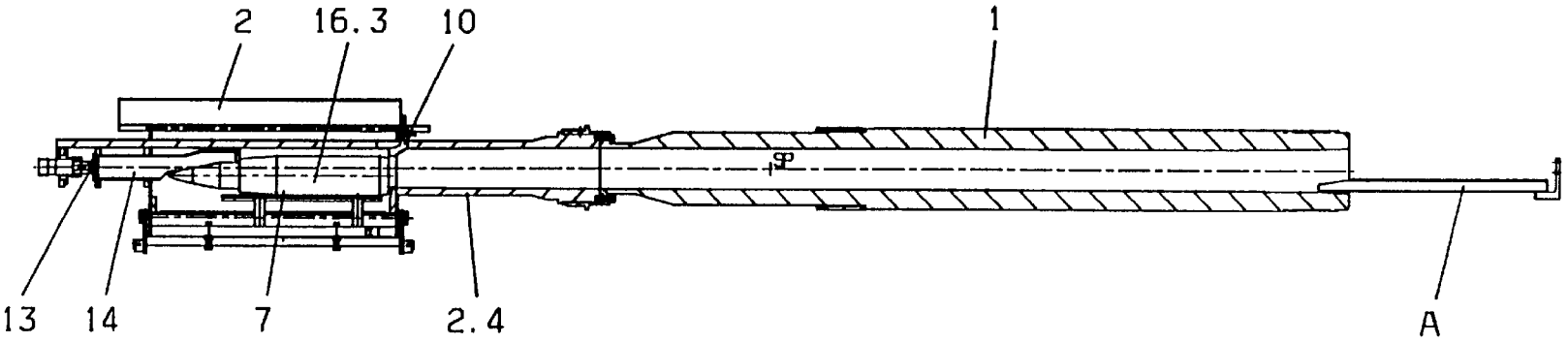
FIG. 9A is a section similar to that in FIG. 5A through the practice barrel and magazine during one stage of a third ramming procedure.
Figure 9B:
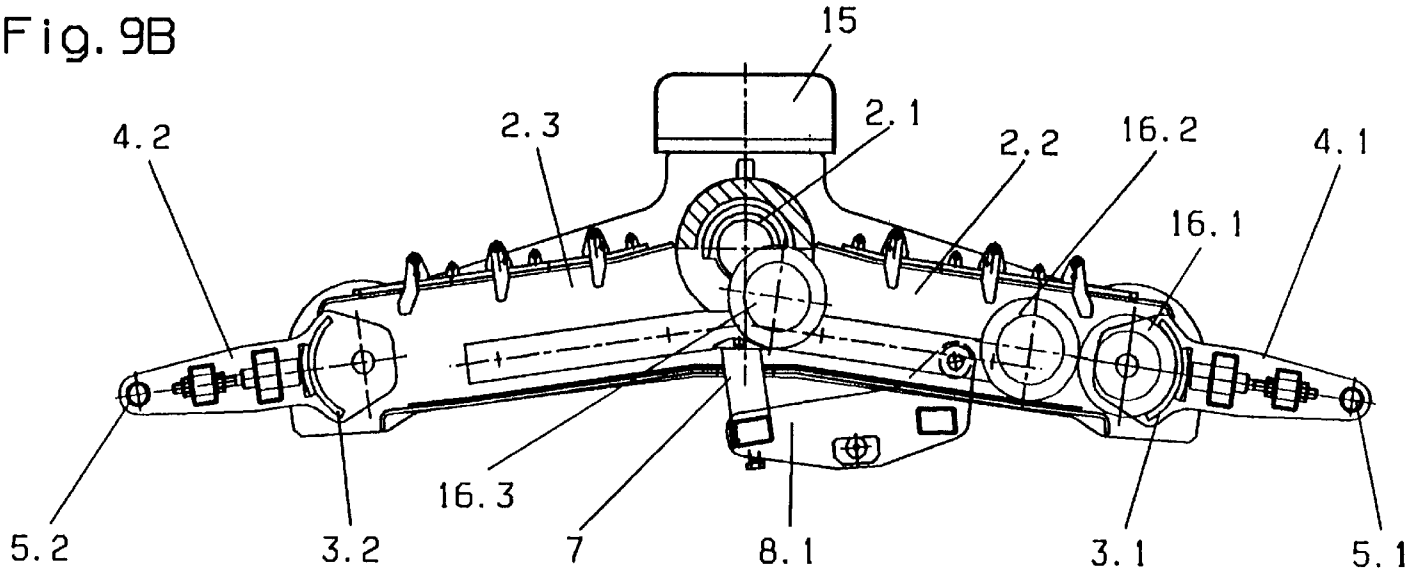
FIG. 9B is a transverse section through the magazine illustrated in FIG. 9A during the same stage.

As will be evident from FIGS. 8A and 8B, the weight of the decelerated shell 16.1 forces rail 7 down, levers 8.1 and 8.2 pivoting down around point 8.3 of articulation against the force exerted by tension springs 9.1 and 9.2. Shell 16.1 is accordingly lowered to the floor of magazine 2. The action of levers 8.1 and 8.2 is monitored by a sensor. As will be evident from FIGS. 9A and 9B, the upper surface 7.1 of rail 7 is bent to ensure that the shell leaving accommodation 2.1 will initially roll as preferred into first magazine shaft 2.2. FIGS. 9A and 9B illustrate the same stage in relation to third shell 16.3, the previously rammed shells 16.1 and 16.2 already in magazine shaft 2.2, whence they will be removed one after the other. Sensors ensure safe operations by determining that cap 3.1 remains closed.

Figure 10A:
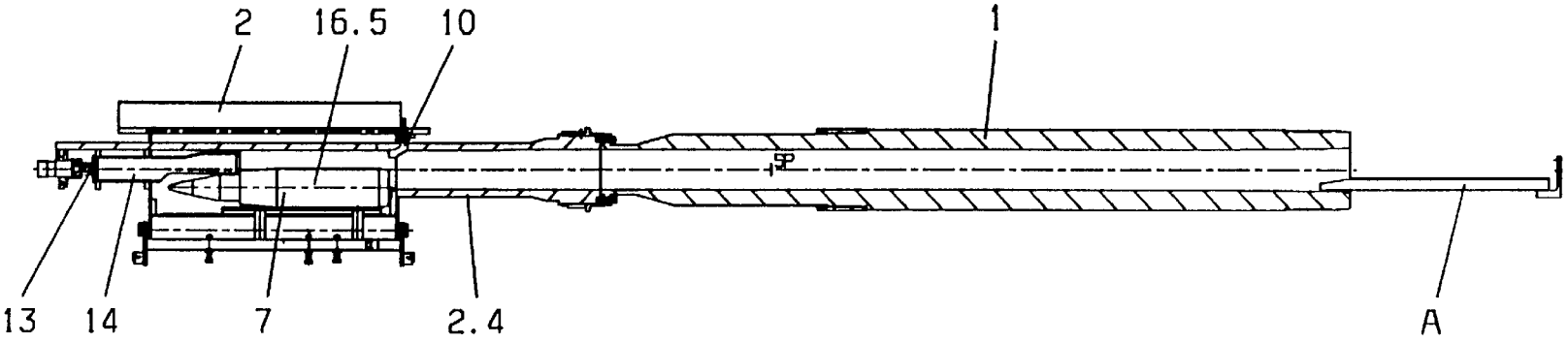
FIG. 10A is a section similar to that in FIG. 5A through the practice barrel and magazine during the fifth stage of ramming.
Figure 10B:
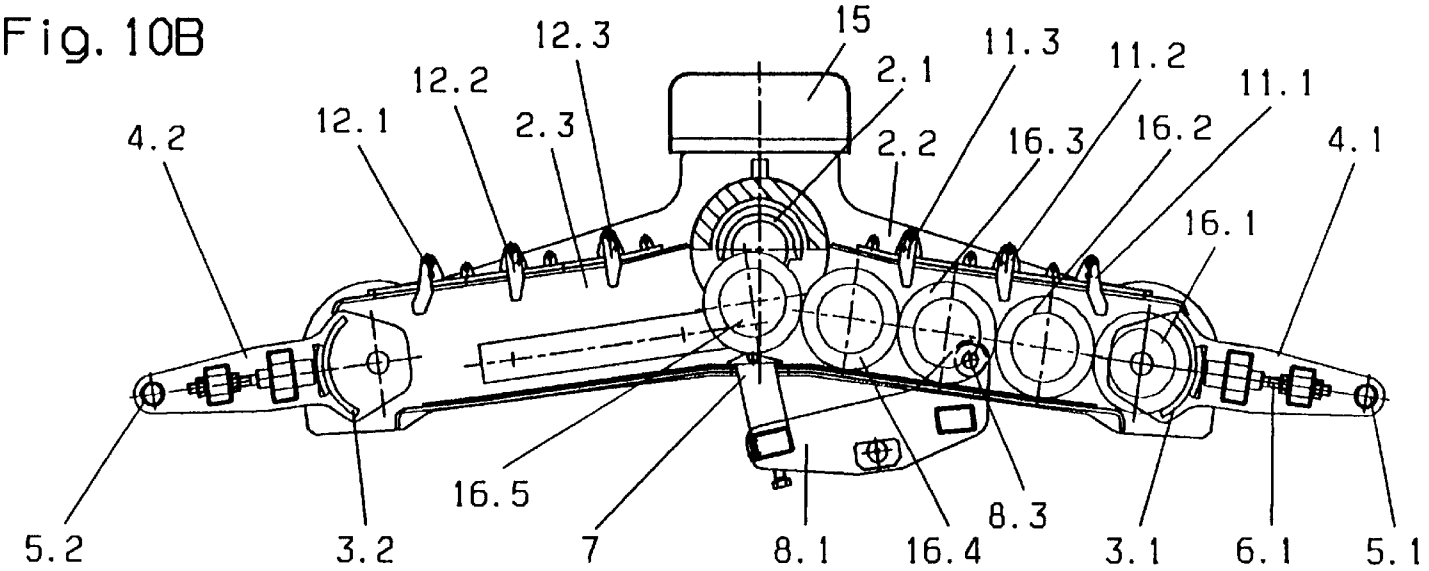
FIG. 10B is a transverse section through the magazine illustrated in FIG. 10A during the same stage.

As will be evident from FIGS. 10A and 10B, first magazine shaft 2.2 is designed to accept four practice shells 16.1, 16.2, 16.3, and 16.4. The shaft is just wide enough across the shells that, once four have been transferred into it, an intermediated displacement will, as will be evident from from FIG. 10B, occur in relation to fifth shell 16.5, which will accordingly roll off into second magazine shaft 2.3. The second shaft can, as previously specified herein, also accept up to four shells. The sensors also ensure that cap 3.2 is closed.

Once eight shells have been rammed and transferred to magazine 2, the magazine will be full and must be emptied before the practice session can continue.

Figure 13:
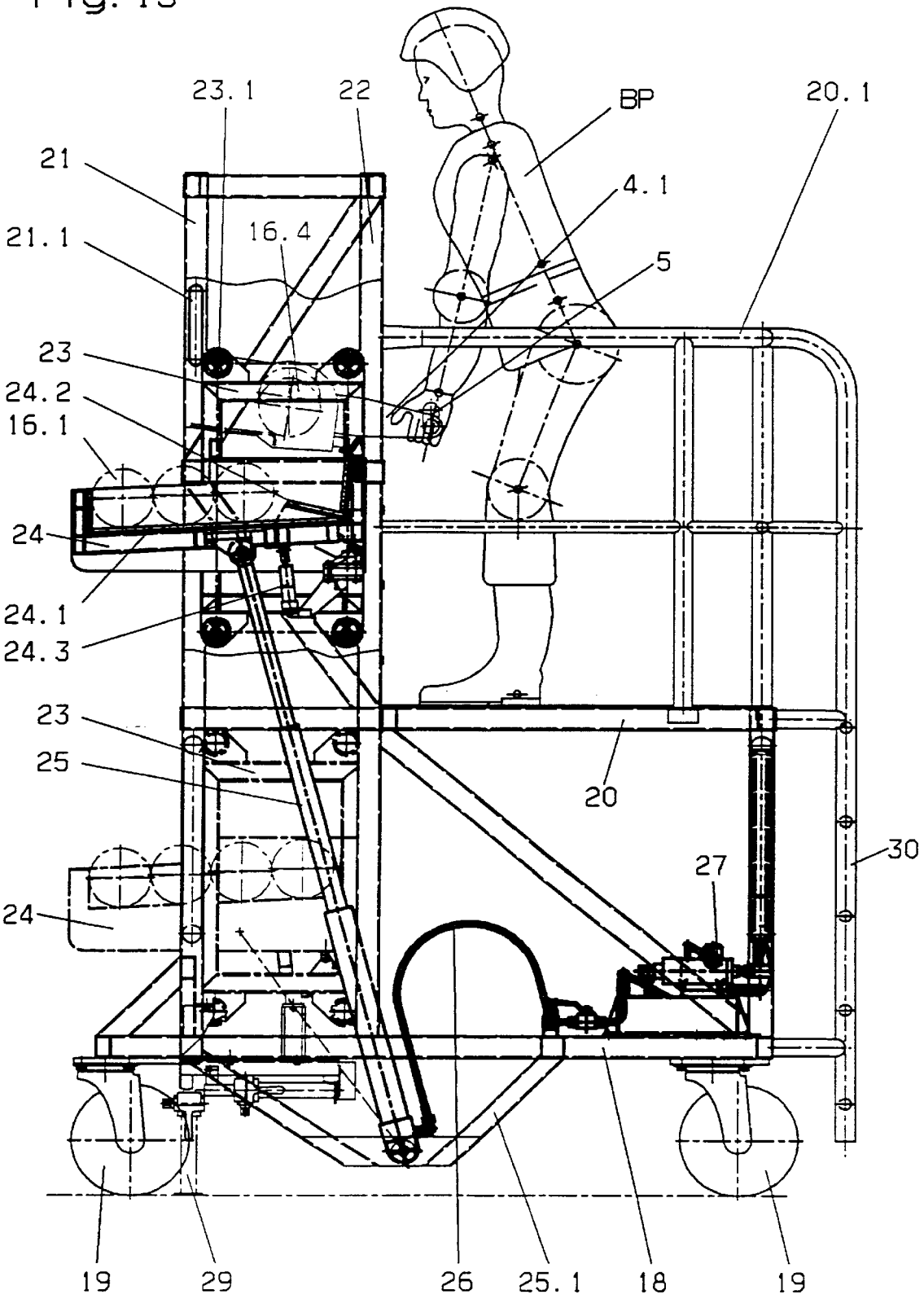
FIG. 13 is a side view of one embodiment of an accessory device employed with the training device illustrated in FIGS. 1 through 10.

The shells are removed from magazine 2 with the special accessory device illustrated in FIG. 13. It and its function will now be specified.

The accessory device illustrated in FIG. 13 comprises a framework 18 mounted on rollers 19. The stability of the framework is enhanced by fold-out braces 25. Mounted on the front of framework 18 are two forward uprights 21 and two rear uprights 22. An elevator 23 travels up and down uprights 21 and 22 on rollers 23.1. Elevator 23 can be raised out of the disengaged position indicated by the discontinuous lines and into the operating position indicated by the continuous lines in FIG. 13 by a piston and cylinder mechanism 25. Mechanism 25 is secured to framework 18 by a bearing block 25.1 and operated by a manual pump 27 by way of a line 26.

Mounted on elevator 23 is a tray 24 that can accept up to four ejected practice shells. The bottom of tray 24 slopes forward and a rocker 24.2 that can accommodate the shells is mounted on shock absorbers 24.3 at the rear, where the shells drop in. At the rear of framework 18 is a ladder 30 that leads up to a platform 20 surrounded by a railing 20.1 and accommodating a standing operator BP.

How the accessory device empties a magazine 2 will now be specified.

Barrel 1 is lowered to an elevation of −2.5° and turret T rotated to one side until the barrel is at an angle of 90° to the length of hull FW (three or nine o'clock). This position provides optimal spatial relations for the reliable advance of the accessory device to the appropriate magazine shaft 2.2 or 2.3. The accessory device is advanced to magazine 2 and secured by fasteners 28 in the form of tensioning rods mounted on shaft 2.2 or 2.3 and thrust into slots 21.1 in forward uprights 21. Elevator 23 is lifted off the ground and into its operating position below the magazine shaft by means of manual pump 27. Operator BP climbs ladder 30 to platform 20. The height of platform 20 is adjusted to the height of the operator to facilitate removing the used shells from the magazine shafts with elevator 23 up.

As will be evident from FIG. 13 in conjunction with FIG. 10B, operator BP grasps a handle 5.1, which can, once a locking mechanism 6.1 has been disengaged, be pivoted up until cap 3.1 uncovers the opening in magazine shaft 2.2. A shell 16.1 can now drop out of magazine shaft 2.2 with the accessory device positioned such that the shell will drop onto the rocker 24.2 in tray 24. The shell's momentum will be accommodated by shock absorbers 24.3, and the shell will roll along the sloping bottom 24.1 to the front of tray 24.

The latches 11.1 through 11.3 in magazine shaft 2.2 ensure that only one shell at a time can drop out of magazine shaft 2.2, and they will retain the others. Latches 11.1 through 11.3 do not disengage until cap 3.1 has closed again, and the shells still in magazine shaft 2.2 can roll in subsequently, another shell assuming the lowermost position in the shaft. This shell can be removed by the hereinbefore described procedure. All four shells 16.1 through 16.4 (indicated by the discontinuous lines in FIG. 13) can now be removed from magazine shaft 2.2 by manipulating handle 5.1 to open and close cap 3.1. An unillustrated manually operated valve can now be opened to initiate the downward travel of elevator 23. The shells can be removed from tray 24 while elevator 23 is at rest.

Second magazine shaft 2.3 is emptied by the same procedure once the accessory device has been disengaged from magazine shaft 2.2 and secured to the second shaft.

What is claimed is:

1. A training device for a combat vehicle with a heavy weapon, comprising:

a) a replacement practice barrel which is shorter than a regular weapon barrel and has attachments at an inner end for fastening same to a combat vehicle;

b) a magazine at an outer end of the practice barrel for accommodating rammed practice shells and having magazine shafts offside an axis of the barrel and into which decelerated rammed practice shells are forwarded and a brake accommodated therein;

c) wherein the practice shells have essentially the same weight and dimensions as regular shells and an impact absorbing portion for accepting the impact of the brake; and d) an accessory device for removing the practice shells from the magazine comprising a framework that travels on rollers and is provided with a platform for operating personnel and with a hydraulic lift that accepts used practice shells from the magazine and lowers them to the ground.

2. The training device as in claim 1, wherein the barrel has a smooth bore and is mounted in a cradle in the vehicle and secured with a breech exactly like a regular barrel.

3. The training device as in claim 1 or 2, wherein the magazine is provided with an accommodation attached concentric to the barrel and in or on the front of which is mounted the brake and on each side of which is mounted the magazine shafts that can accept several practice shells provided by a conveyance.

4. The training device as in claim 3, wherein the magazine shafts mounted on each side of the accommodation slope at a slight angle to a plane defined by the axis of barrel and an axis of elevation.

5. The training device as in claim 1, further comprising an extraction opening on an outer end of each magazine shaft and caps for closing same, each connected to an outward-extending arm connected to a handle.

6. The training device as in claim 5, wherein each arm can be locked in place by locking mechanisms while the caps are closed.

7. The training device as in claim 3, further comprising a rail that supports the shells in the accommodation as they enter and are decelerated, and wherein the rail drops against the force exerted by springs, and is bent such that, once it has dropped, the decelerated shell will roll off of it into, initially, a first magazine shaft.

8. The training device as in claim 7, wherein the first magazine shaft is just wide enough that, once it has accepted a prescribed maximum of shells, the next shell to enter the accommodation will be intermediately displaced with respect to a second magazine shaft and will drop into it.

9. The training device as in claim 7 or 8, wherein the rail is articulated to free ends of two suspension levers, each of which is articulated to a front and rear of the magazine in the vicinity of the first magazine shaft and tending to swing down against the force exerted by tension springs.

10. The training device as in claim 3, further comprising a latch positioned at an entry into the accommodation to prevent a rammed shell from sliding backward.

11. The training device as in claim 1, further comprising releasable latches in the magazine shafts that determine the position of the practice shells in the shafts.

12. Training device as in claim 3, wherein the brake has a shock absorber that a tray slides back and forth on along the accommodation, wherein the tray has a stop on the side facing an incoming shell and resting against the shell.

13. The training device as in claim 5, wherein settings of the arms control the shells in the magazine.

14. The training device as in claim 13, further comprising electronic controls under a hood on top of the magazine.

15. The training device as in one claim 1, wherein the shell has an ogive at the front portion and a removable base and wherein the impact absorbing portion comprises an impact accommodating shoulder turned out of a section adjacent to the ogive.

16. The training device as in claim 15, wherein the ogive is attached to the shell by a threaded joint and wherein the shoulder is in the vicinity thereof.

17. The training device as in claim 16, further comprising a replaceable plastic shock-absorption ring around the impact accommodating shoulder.

18. The training device as in claim 15, wherein the shell further comprises a screw-in fuse.

19. The training device as in claim 1, wherein the accessory device comprises four uprights against the framework, along which the elevator with the tray travels and wherein the hydraulic lift has hydraulic components that raise and lower the elevator and are accommodated in a bottom of the framework.

20. The training device as in claim 19, wherein the tray has a sloping bottom and a rocker that can accommodate the shells and which is mounted on shock absorbers at a rear portion where the shells drop in.

21. The training device as in claim 19 or 20, further comprising adjustment-and-securing structures mounted on the shafts and thrust into slots in forward uprights.

* * * * *